US006406546B1

(12) United States Patent
Donovan et al.

(10) Patent No.: US 6,406,546 B1
(45) **Date of Patent: *Jun. 18, 2002**

(54) PROCESS FOR PURIFICATION OF LOW GRADE SUGAR SYRUPS USING NANOFILTRATION

(75) Inventors: Michael Donovan, Little Canfield; Marc Hlavacek, London, both of (GB)

(73) Assignee: Tate & Lyle Industries, Limited, London (GB)

( * ) Notice: Subject to any disclaimer, the term of this patent is extended or adjusted under 35 U.S.C. 154(b) by 35 days.

This patent is subject to a terminal disclaimer.

(21) Appl. No.: 09/618,234

(22) Filed: Jul. 18, 2000

Related U.S. Application Data

(63) Continuation-in-part of application No. 09/441,988, filed on Nov. 17, 1999.

(51) Int. Cl.[7] ..... C13D 1/16

(52) U.S. Cl. ..... 127/55; 127/54

(58) Field of Search ..... 127/55, 54

(56) References Cited

U.S. PATENT DOCUMENTS

| | | | |
|---|---|---|---|
| 1,578,463 A | 3/1926 | Nicholson et al. | |
| 1,815,276 A | 7/1931 | Schwieger | |
| 2,164,186 A | 6/1939 | Brown et al. | 127/50 |
| 2,557,800 A | 6/1951 | Seailles | 127/52 |
| 2,697,049 A | 12/1954 | Brieghel-Müller | 127/50 |
| 2,801,940 A | 8/1957 | Stark et al. | 127/44 |
| 2,824,028 A | 2/1958 | Zenzes | 127/50 |
| 2,977,253 A | 3/1961 | Grandadam | 127/50 |
| 3,113,044 A | 12/1963 | Alston | 127/48 |
| 3,168,419 A | 2/1965 | Gale | 127/50 |

(List continued on next page.)

FOREIGN PATENT DOCUMENTS

| | | |
|---|---|---|
| CS | 107886 | 7/1963 |
| DE | 813139 | 9/1951 |
| DE | 942552 | 5/1956 |
| DE | 1 003 150 | 8/1957 |
| EP | 095178 A2 | 11/1999 |
| FR | 2 701 359 | 8/1994 |
| WO | WO92/08810 | 5/1992 |
| WO | WO92/10948 | 7/1992 |
| WO | WO93/07766 | 4/1993 |
| WO | WO98/17378 | 4/1998 |
| WO | WO98/24331 | 6/1998 |

OTHER PUBLICATIONS

Nielsen et al., "Prospects and Possibilities in Application of Membrane Filtration Systems Within the Beet and Cane Sugar Industry," *Sugar Technology Reviews* 9:59–117 (1982) no month provided.

Kishihara et al., "Improvement of Flux in Ultrafiltration of Cane Juice," *Int. Sugar Jnl.* 85:99–102 (1983) no month provided.

(List continued on next page.)

*Primary Examiner*—David Brunsman
(74) *Attorney, Agent, or Firm*—Williams, Morgan & Amerson, P.C.

(57) ABSTRACT

A nanofiltration process for obtaining sucrose uses a feed syrup, such as molasses, that comprises sucrose and no less than about 2% by weight invert sugars (on a dry solids basis). The nanofiltration produces a permeate and retentate. The nanofiltration permeate will comprise invert sugars that have passed from the feed through the nanofiltration membrane, and preferably will also comprise ash from the feed. The nanofiltration retentate has a higher concentration of sucrose and a lower concentration of invert sugars than the feed syrup. Sucrose can then be crystallized from the nanofiltration retentate. The reduction of the invert content in the syrup facilitates crystallization and thus enhances sucrose recovery.

18 Claims, 6 Drawing Sheets

U.S. PATENT DOCUMENTS

| | | | | | |
|---|---|---|---|---|---|
| 3,926,662 | A | | 12/1975 | Rundell et al. | 127/48 |
| 4,115,147 | A | | 9/1978 | Shimizu et al. | 127/54 |
| 4,328,043 | A | | 5/1982 | Freytag et al. | 127/44 |
| 4,332,622 | A | | 6/1982 | Hohnerlein, Jr. | 127/41 |
| 4,432,806 | A | | 2/1984 | Madsen et al. | 127/48 |
| 4,478,645 | A | | 10/1984 | Gudnason | 127/57 |
| 4,702,839 | A | | 10/1987 | Koerts et al. | 210/638 |
| 4,716,044 | A | | 12/1987 | Thomas et al. | 426/51 |
| 4,795,494 | A | | 1/1989 | Toth et al. | 127/48 |
| 5,145,584 | A | | 9/1992 | Swamikannu | 210/650 |
| 5,254,174 | A | | 10/1993 | Hansen et al. | 127/53 |
| 5,281,279 | A | | 1/1994 | Gil et al. | 127/46.1 |
| 5,320,681 | A | | 6/1994 | Moe et al. | 127/46.1 |
| 5,403,604 | A | | 4/1995 | Black, Jr. et al. | 426/330.5 |
| 5,454,952 | A | | 10/1995 | Brewer | 210/651 |
| 5,466,294 | A | | 11/1995 | Kearney et al. | 127/42 |
| 5,468,300 | A | | 11/1995 | Monclin | 127/43 |
| 5,468,301 | A | | 11/1995 | Monclin | 127/43 |
| 5,480,490 | A | | 1/1996 | Toth et al. | 127/42 |
| 5,554,227 | A | | 9/1996 | Kwok et al. | 127/58 |
| 5,685,990 | A | | 11/1997 | Saugmann et al. | 210/650 |
| 5,747,089 | A | | 5/1998 | Ljusberg et al. | 426/478 |
| 5,759,283 | A | | 6/1998 | Ekern et al. | 127/42 |
| 5,902,408 | A | | 5/1999 | Player et al. | 27/30 |
| 5,902,409 | A | | 5/1999 | Kwok et al. | 127/58 |
| 6,096,136 | A | * | 8/2000 | Saska | 127/42 |

OTHER PUBLICATIONS

Hanssens et al., "Ultrafiltration as an Alternative for Raw Juice Purification in the Beet Sugar Industry" (17$^{th}$ General Assembly of C.I.T.S., Copenhagen (1983) no month provided.

"Membrane Filtration," *Food Engineering* (Nov. 1987).

"Purification Using Membrane Filtration," *Sugar Journal* (Nov. 1994).

Abram et al., "Sugar Refining: Present Technology and Future Developments," *Sugar: Science and Technology*, Chapter 3, pp. 49–95 (1979) no month provided.

Kort, "Colour in the Sugar Industry," *Sugar: Science and Technology*, Chapter 4, pp. 97–130 (1979) no month provided.

Reinefeld, "Progress in the Technology of Beet–Sugar," *Sugar: Science and Technology*, Chapter 5, pp. 131–149 (1979) no month provided.

Chen, "Outline of Process for Manufacturing Raw Cane Sugar," *Cane Sugar Handbook*, Chapter 2, pp. 47–105, 127–186 and 526–559 (1985) no month provided.

Lancrenon et al., "Mineral Membranes for the Sugar Industry," *Sugar y Azucar*, pp. 40–45 (1993) no month provided.

Hartmann, "Lime and Carbon Dioxide Production," *Beet–Sugar Technology*, Chapter XVII, pp. 567–593 (1982) no month provided.

Toth, "The Wescot Juice Purification System" (1989 ASSBT Meeting, New Orleans, Louisiana, Feb. 26–Mar. 2, 1989).

"Beet Sugar Process," Western Sugar no date provided.

Derwent Abstract, DD 136455 (1979) no month provided.

Derwent Abstract, DE 3229345 (1984) no month provided.

Derwent Abstract, EP 635578 (1995) no month provided.

Derwent Abstract, EP 655507 (1995) no month provided.

Derwent Abstract, RU 2016637 (1994) no month provided.

Derwent Abstract, JP 5004929 (1993) no month provided.

Derwent Abstract, JP 6287199 (1994) no month provided.

Derwent Abstract, SU 1669984 (1991) no month provided.

Derwent Abstract, NL 8800175 (1989) no month provided.

Derwent Abstract FR 2586360 (1987) no month provided.

Derwent Abstract, US 4999116 (1991) no month provided.

Derwent Abstract, RU 2016637 (1994) no month provided.

Derwent Abstract, JP 5004929 (1993) no month provided.

Derwent Abstract, DE 3229345 (1984) no month provided.

Derwent Abstract, US 5008254 (1991) no month provided.

Derwent Abstract, JP 6287199 (1994) no month provided.

Derwent Abstract, SU 1756817 (1992) no month provided.

Derwent Abstract, SU 1669984 (1991) no month provided.

Derwent Abstract, WO 9208810 (1992) no month provided.

Derwent Abstract, NL 8800175 (1989) no month provided.

Derwent Abstract, FR2586360 (1987) no month provided.

Derwent Abstract, DE 3229345 (1984) no month provided.

Derwent Abstract, DD 136455 (1979)no month provided.

Freeman, "New Processes for Recovering Sugar from Sugar Beets," *Sugar* 48:161–162 (1953)no month provided.

Dorfeldt, "Manufacture of Sugar from Rasped Beets," *Zeitschrift Zuckerindustrie* 2:379–383 (1952)no month provided Brownell et al., "Explosion Process for Recovering Sugar from Sugar Beets," *Sugar*, p. 66 (1952) no month provided.

Cheryan, "Membrane Separation Processes and Their Use in Purifying or Concentrating Liquid Food Systems," *Activity Report, Research and Development Associates for Military Food and Packaging Systems* 44:164–151 (1992) no month provided.

Urano et al., "Separation Properties for Oligosaccharides of Nanofiltration Membranes and Its Application to a Purification Process of Jerusalem Artichoke Oligosaccharides," *Nippon Shokuhin Kagaku Kogaku Kaishi* 44:457–462 (1997) no month provided.

Madsen, "New Developments in the Purification of Beet Sugar," *Int. Sugar Jnl.* 92:221–223 (1990) no month provided.

Saska et al., "Direct Production of White Cane Sugar with Clarification and Decolorization Membranes—Part I," *Sugar Journal* 58:19–21 (1995) no month provided.

Saska et al., "Direct Production of White Cane Sugar with Clarification and Decolorization Membranes—Part II," *Sugar Journal* 58:29–31 (1995) no month provided.

Saska et al., "Concentration and Decolorization of Dilute Products from Cane Molasses Desugarization with Reverse Osmosis and Nanofiltration Membranes," 1994 Sugar Industry Technologists Meeting, Honolulu, Hawaii (May 8–11,, 1994) no month provided.

Cartier et al., "Développement Actuel et Potentiel Des Procédés À Membranes en Sucrerie et Raffinerie De Canne," *Ind. Alim. Agr. Juillet/Août*, pp. 557–560 (1996) no month provided.

Spengler et al., "Experiments on Raw Juice Extraction, Using a Continuously Operating Diffusor from Harburger Oelwerke Brinckman & Mergell," *Ztschr. Wirtschaftsgruppe Zuckerind*91:275–333 (1941) no month provided.

Müller, "Extraction of Raw Juice According to the Steckel Process," *Zeitschrift fur die Zuckerindustrie*, pp. 207–209 (1961)no month provided.

"Desugarization of Sugar Beet Mash"no date provided.

Dörfeldt, "Raw Juice Extract from Beet Pulp," *Zuckerindustrie: Fachorgan für Technik, Rübenbau und Wirtschaft* 2:379–383 (1952)no month provided.

Schneider, "Beet Comminution," *Technologie des Zuckers*, pp. 135–136, 171 (excepts) (1968)no month provided.

Madsen, "New Developments in the Purification of Beet Sugar," *Int. Sugar Jnl.*, 92:221–223 (1990) no month provided.

PCT/GB00/04321 International Search Report no date provided.

* cited by examiner

PROCESS FOR PURIFICATION OF LOW GRADE SUGAR SYRUPS USING NANOFILTRATION

This is a continuation-in-part of U.S. application Ser. No. 09/441,988, filed on Nov. 17, 1999.

BACKGROUND OF THE INVENTION

The present invention relates to a process for recovering sucrose from low grade sugar syrups, juices, or liquors, such as molasses, that also contain a significant concentration of invert sugars.

The production of cane sugar for human consumption generally comprises two distinct operations, namely the production of raw sugar and the production of refined sugar. Production of raw sugar typically takes place at a sugar mill. In the mill, sugar cane stalks are chopped into pieces and the pieces are crushed in a series of mills in order to remove the juice. The juice from the first set of roller mills is referred to as "first juice," while the total juice from all the roller mills in the process is referred to as "mixed juice." The juice is normally limed, deaerated and clarified (i.e., removal of suspended solids, usually by sedimentation). The clarified stream is referred to as "clarified juice." The juice is then evaporated to a thick syrup (known as "evaporated juice" or "thick juice"), and crystallized in a vacuum pan. The "massecuite" (i.e., mixture of sugar syrup and crystals) produced in the vacuum pan is stirred in a crystallizer, and the mother syrup is spun off from the raw sugar crystals in a centrifugal separator. The solid sugar in the centrifugal basket is washed with water to remove remaining syrup. The solid crystalline product is termed "raw sugar." The syrup remaining after multiple stages of crystallization and centrifugation is referred to as "cane mill molasses" and is typically used for animal feed or fermentation syrups.

Raw sugar from the mill is usually transported to a sugar refinery for further processing. In a conventional cane sugar refining process, the raw sugar is first washed and centrifuged to remove adherent syrup, and the "affined sugar" thus produced is dissolved in water as "melter liquor." The syrup removed from the surface of the raw sugar is known as "affination syrup" and is broadly similar in composition to the mother syrup from the raw sugar crystallization. The affination syrup is processed in a "recovery section" through a series of vacuum pans, crystallizers and centrifugal separators similar to those used for the production of raw sugar, to recover an impure crystalline sugar product which has approximately the same composition as raw sugar. This recovered sugar product is dissolved in water, along with the affined raw sugar, to make melter liquor. The syrup remaining after the multiple stages of crystallization and centrifugation is referred to as "cane refinery molasses," and is typically used for animal feed or fermentation syrups.

The melter liquor is purified, generally by the successive steps of clarification (also referred to as "defecation") and decolorization, and the resulting "fine liquor" is crystallized to give refined sugar (also known as "white sugar"). The clarification step usually involves forming an inorganic precipitate in the liquor, and removing the precipitate and along with it insoluble and colloidal impurities which were present in the melter liquor. In one of the clarification processes commonly used for melter liquor, termed "carbonatation" or "carbonation," the inorganic precipitate is calcium carbonate, normally formed by the addition of lime and carbon dioxide to the liquor. The calcium carbonate precipitate is usually removed from the liquor by filtration. Other clarification processes, termed phosphatation processes, involve adding lime and phosphoric acid to the liquor, and produce calcium phosphate precipitate.

The molasses produced in cane mills and refineries contains a substantial concentration of sucrose (e.g., 35–55% by weight on a dry solids basis). However, that sucrose cannot be recovered readily by additional crystallizations, because the molasses contains such a high concentration of impurities, including invert sugars (a mixture of glucose and fructose). The sucrose in the molasses could be sold for a far higher price than the molasses, if only the sucrose could be separated from the other constituents of the molasses in an economical way. However, the prior art has failed to provide a practical and cost-effective way to make this separation for cane syrups where invert is a significant component.

Chromatographic separation is used to desugar beet molasses and is being proposed for cane, but beet molasses has no invert and it is more straightforward to separate the sucrose. Chromatographic separation is an expensive process for cane.

There is a long-standing need for improved processes for enhancing recovery of sucrose from low grade cane syrups such as molasses.

SUMMARY OF THE INVENTION

The present invention concerns a process for obtaining sucrose from a feed syrup that comprises sucrose and no less than about 2% by weight invert sugars (on a dry solids basis), or in some embodiments no less than about 3%. The process involves nanofiltration of this feed using a membrane, whereby a nanofiltration permeate and a nanofiltration retentate are produced. The nanofiltration permeate will comprise invert sugars that have passed from the feed through the nanofiltration membrane, and preferably will also comprise ash and organic acids. The nanofiltration retentate has (1) a concentration of sucrose that on a dry solids basis is higher than the concentration of sucrose in the feed syrup, and (2) a concentration of invert sugars that on a dry solids basis is lower than the concentration of invert sugars in the feed syrup. The nanofiltration retentate is recovered and sucrose can be crystallized therefrom. The reduction of the invert content facilitates crystallization and thus enhances sucrose recovery.

Preferably, the feed syrup comprises at least about 5%, more preferably at least about 15% invert sugars on a dry solids basis. Suitable feed syrups include, for example, cane mill molasses, cane refinery molasses, and beet molasses, as well as a variety of other syrups, liquors, and juices, which are all referred to as "syrups" in the context of this invention. In some embodiments of the process, more than about 50% by weight, preferably more than about 75%, more preferably more than about 90% by weight of the invert sugars in the feed syrup pass through the nanofiltration membrane and into the nanofiltration permeate.

It is preferred that the nanofiltration membrane have a molecular weight cutoff of about 150–300 daltons. It is also preferred that, prior to nanofiltration, the feed syrup be pre-filtered through a microfiltration or ultrafiltration membrane. This will produce a microfiltration or ultrafiltration retentate and a microfiltration or ultrafiltration permeate. This permeate is subsequently filtered through the nanofiltration membrane. The microfiltration or ultrafiltration retentate comprises at least one impurity that was present in the feed syrup and is selected from the group consisting of colloids, polysaccharides, and color-forming materials. In especially preferred embodiments of the process, more than about 50% by weight of the colloids, polysaccharides, and color-forming materials in the feed syrup pass into the microfiltration or ultrafiltration retentate.

Optionally, the process can also include the step of diafiltration of the microfiltration or ultrafiltration retentate. This will produce a diafiltration retentate and a diafiltration permeate, and the former will have a reduced sucrose content compared to the microfiltration or ultrafiltration retentate. The diafiltration permeate can be combined with the microfiltration or ultrafiltration permeate prior to nanofiltration.

In the present invention, the crystallization of the nanofiltered material of course produces crystalline sucrose, but also produces a molasses byproduct, which can be recycled into the feed syrup, or can be used for other purposes such as animal feed or fermentation syrup. If this molasses byproduct stream is recycled to the feed syrup, it is usually preferable to withdraw a bleed stream from the recycled byproduct in an amount sufficient to prevent buildup of impurities in the process to an extent that would inhibit crystallization of sucrose.

One specific embodiment of the present invention is a process for obtaining sucrose from molasses. This process includes the steps of:

(a) filtration of molasses that comprises sucrose and no less than about 5% invert sugars (on a dry solids basis), preferably at least about 10% invert sugars using a microfiltration or ultrafiltration membrane, whereby a first permeate and a first retentate are produced, wherein the first retentate comprises at least one impurity that was present in the molasses and is selected from the group consisting of colloids, polysaccharides, and color-forming materials;

(b) nanofiltration of the first permeate using a nanofiltration membrane having a molecular weight cutoff of about 150–300 daltons, whereby a second permeate and a second retentate are produced, wherein the second permeate comprises more than about 75% by weight of the invert sugars that were in the molasses, and wherein the second retentate has a concentration of sucrose that on a dry solids basis is higher than the concentration of sucrose in the molasses; and (c) crystallization of sucrose from the second retentate.

The present invention provides a relatively simple and low-cost process for enhancing sucrose recovery. The present invention is especially useful for recovery of additional sucrose from molasses, thereby allowing the overall product mix of a sugar manufacturing facility to be sold for a higher aggregate price.

The present invention provides a method of increasing the sucrose content of syrup, and lowering its invert and ash content sufficiently for the sucrose to be recovered by crystallization. For example, a typical molasses from a sugar cane refinery contains 50% sucrose, 23% invert, 17% ash, and 10% other organic components. It is possible to use the process described here to reduce the invert level from 23% to 2%, and reduce the ash level from 17% to 7%, giving a purified syrup with a sucrose content of 75%. The upgraded syrup from this process can be fed to crystallization equipment to recover more sucrose. There will be a small loss of sucrose into the permeate from the nanofiltration membrane, which is the by-product of the nanofiltration process. This permeate material often will have 20% or less sucrose, which gives an 80% yield of sucrose from the syrup. This nanofiltration byproduct would comprise 45% invert, and with a total sugars content of 65% could be sold as a fermentation syrup.

DETAILED DESCRIPTION OF SPECIFIC EMBODIMENTS

The process of the invention can be used with a variety of low grade sucrose-containing syrups (i.e., syrups that contain some sucrose but also contain substantial concentrations of other sugars and impurities). Molasses from cane mills and cane refineries are two suitable examples of such low-grade syrups. Beet molasses, beet thick juice, and beet thin juice from the refining of sugar beets are other suitable examples. Other liquors and syrups to which this process can be applied include mill first juice, mixed juice, incubated juice, clarified juice, thick juice, A molasses, B molasses, plus refinery liquors and syrups such as affination syrup, jet syrups or run-off syrups produced by white sugar crystallizations, first crop syrup, and second crop syrup. In general, the syrups which can be treated using the present invention preferably have a beginning sucrose content of about 35–95% on a dry solids basis.

Cane sugar is commonly produced in two stages, the first stage being a cane mill which produces raw sugar, and the second stage being a refinery which converts the raw cane sugar to refined white sugar. The cane juice extracted from sugar cane usually has a sucrose content of 80 to 90%. (All percentages given in this patent are by weight and on a dry solids basis unless otherwise stated.) The impurities include color, invert (which is almost equal parts of glucose and fructose), ash (mainly potassium, calcium, sodium, chloride, sulfate and phosphate), organic acids (mainly lactic acid), polysaccharides, waxes, and gums. All of these impurities must be removed in the cane mill and the refinery in order to make white sugar. The cane juice that contains 80 to 90% sucrose is crystallized in the mill to produce a raw sugar that is 96 to 99.5% sucrose. The mother liquor from this crystallization is usually crystallized twice more, with the sugar being produced in the third of these crystallizations (or sometimes in both the second and third crystallizations) usually used as seed in the first or "A" crystallization. The final mother liquor is molasses, and is usually composed of about 35–50% sucrose, 10–20% glucose and fructose (invert), 15% ash, and the remainder other organic material.

Figure 1:
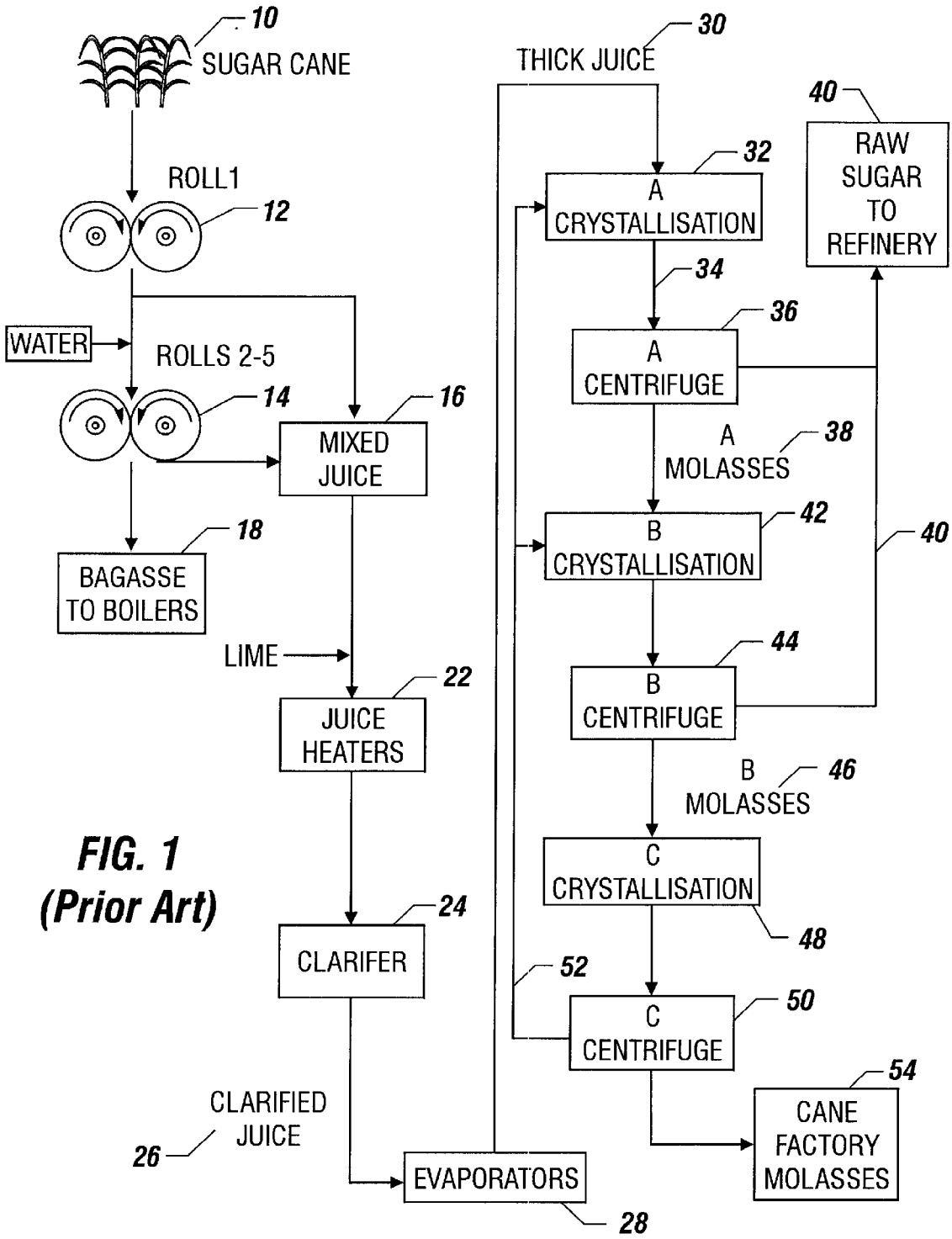
FIG. 1 (Prior Art)
FIG. 1 is a process flow diagram for a cane mill.

FIG. 1 shows one specific embodiment of a sugar cane mill. In the mill, sugar cane stalks 10 are chopped into pieces and the pieces are crushed in a series of roller mills in order to remove the juice. The juice from the first set of roller mills 12 is referred to as first juice, while the total juice from all the roller mills (12, 14) in the process is referred to as mixed juice 16. The solid stalk material that remains after the juice is removed is termed "bagasse" 18 and is typically used as boiler fuel. The juice is heated 22 to about 105° C. after addition of lime and clarified 24 (i.e., removal of suspended solids, usually by sedimentation). The clarified juice 26 is then evaporated 28 to form thick juice 30, and crystallized in a first vacuum crystallization pan 32 (the "A crystallization"). The massecuite 34 (mixture of sugar syrup and crystals) from the A crystallization is sent to a centrifugal separator 36 where the mother syrup (or "A molasses") 38 is spun off from the raw sugar 40. The A molasses 38 is then sent to a second crystallizer 42, where the B crystallization takes place. The massecuite from the B crystallization is separated in the B centrifuge 44 into raw sugar 40 and B molasses 46. The latter is sent to a third crystallizer 48. The massecuite from this C crystallization is sent to a third centrifugal separator 50. The crystals 52 obtained from this C centrifuge are used as seed crystals in the A and B crystallizations (32, 44). The remaining syrup is cane mill molasses 54. Further crystallizations of sucrose from this molasses are generally not feasible due to its high invert and ash content.

Figure 2:
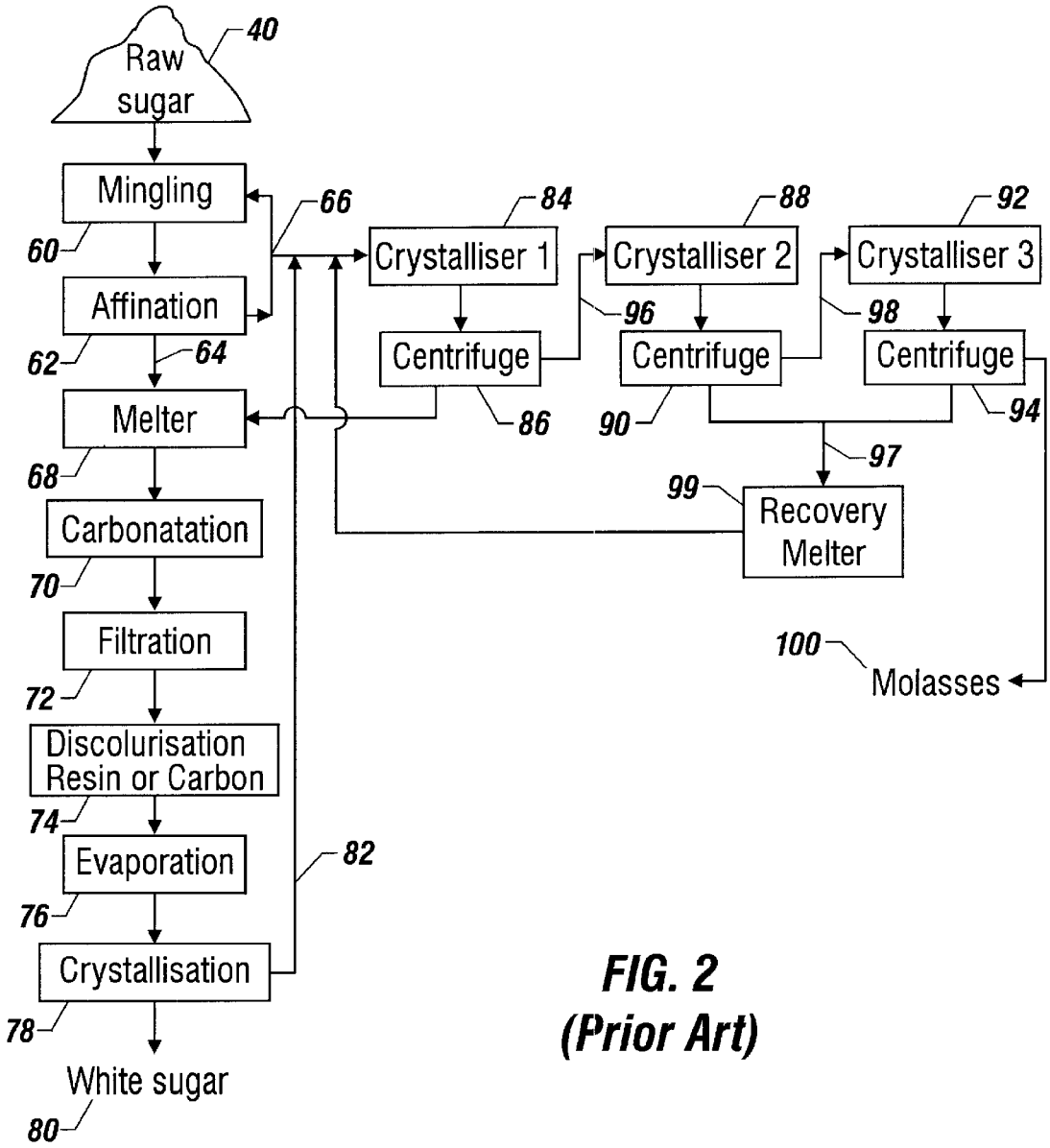
FIG. 2 (Prior Art)
FIG. 2 is a process flow diagram for a cane sugar refinery.

Raw sugar is sent to a refinery for further processing. A diagram of a typical cane sugar refinery is shown in FIG. 2. The first step in a refinery is usually a mingling and affination step using centrifuges 60 and 62. These affination centrifuges give washed crystals 64 of 99.5 to 99.8% sucrose and an affination syrup 66 that is 80 to 90% sucrose. This affination syrup is usually sent to a recovery or remelt process where some of the sucrose content is recovered.

The affined sugar 64 is melted 68 and purified by carbonatation 70, filtration 72, and decolorization 74, and then evaporated 76 and crystallized 78 to produce white sugar 80. The mother liquor from this crystallization is separated from the white sugar in a centrifuge and is then crystallized again to make a second strike of white sugar. This process is repeated three or four times, making white sugar 80 each time. After the third or fourth crystallization, white sugar cannot be made from the sugar liquor. This final mother liquor 82 is then sent to the recovery or remelt process to recover sucrose. It usually contains from 85 to 92% sucrose and is often mixed with the affination syrup 66 produced in the affination stage. The sugar is separated from these syrups by crystallization. Although the mixed affination syrup and final mother liquor from white sugar crystallization usually are mixed and crystallized together, it is also possible to crystallize them separately.

In the specific embodiment shown in FIG. 2, the affination syrup 66 and final mother liquor 82 are combined and sent to a recovery section which comprises three crystallizers (84, 88, 92) and three associated centrifuges (86, 90, 94). The crystallized sugar from the first crystallizer 84 separated from syrup in the centrifuge 86 and combined with the main sugar stream in the melter 68, where it is mixed in and passes to carbonatation and decolorization. The mother liquor 96 from the first crystallization in the recovery section is then crystallized a further two times (88, 92). The sugar 97 produced can be melted in a recovery melter 99 and sent to the main sugar stream, or more usually sent to the first of the recovery or remelt crystallizations. The final mother liquor 100 is molasses. It is not possible to crystallize any more sucrose from molasses because of the solubility characteristics of sucrose in the molasses. The composition of this molasses is typically 40 to 50% sucrose, 10 to 20% invert (glucose and fructose), 10 to 15% ash, and 10 to 25% other material, mainly organic materials such as polysaccharides and waxes.

The overall sucrose yield of a refinery is quite high, often in the range 95 to 98%. However, although the sucrose lost in the molasses is relatively small as a percentage of the total sucrose in the cane, it amounts to a large absolute quantity, taking into account the large volumes of material processed. This lost sucrose would be much more valuable if it could be recovered economically and sold separately, than it is as a component of the relatively low-value molasses.

The present invention uses nanofiltration to help recover much of this previously wasted sucrose. By separating sucrose from invert sugars, and preferably also from ash, the present invention converts low grade syrups from which pure sucrose cannot be readily crystallized, into higher grade syrups from which pure sucrose can be recovered by additional crystallizations.

Molasses or low grade syrups contain a large amount of fine suspended solids and high molecular weight materials, particularly polysaccharides and color-forming materials. These impurities can foul a membrane with small pores such as a nanofiltration membrane. A nanofiltration membrane will separate invert and other impurities without any prior membrane treatment, but it is not as effective. Therefore, it is preferred that nanofiltration of the molasses or other low grade syrup be preceded by either microfiltration or ultrafiltration, or optionally both, to remove larger impurities that might foul the nanofiltration membrane or inhibit crystallization of sucrose. The microfiltration membrane can have a pore size of about 0.02 to 0.2 microns, and the ultrafiltration membrane can have a pore size of from about 2000 daltons to 100,000 daltons. Of course, multiple stages of microfiltration, ultrafiltration, and/or nanofiltration can be included in the process, optionally with other unit operations taking place in between such membrane filtrations.

One embodiment involves treating sugar cane juice after it has been extracted by crushing the cane. The juice used could be first juice, mixed juice or clarified juice. It could also be partly evaporated juice at up to 50% dry solids (50 Brix). As mentioned above, this juice would need to be filtered and/or clarified prior to nanofiltration to prevent blocking or fouling of the nanofiltration membrane and membrane system. This can be done using either or both a microfiltration membrane and a ultrafiltration membrane. A typical cane juice could be treated to increase the sucrose content from 85 to 95%, allowing a higher yield of sucrose to be obtained by conventional crystallization, either in the form of raw sugar or plantation white sugar.

The molasses produced at a cane mill can also be treated using nanofiltration technology to generate a syrup that has reduced invert and ash content compared to the molasses, and thus can be used as the feed for further crystallizations of sucrose. The method of doing these further crystallizations would be very similar to what is done in the recovery section of a cane refinery. Again the molasses usually would preferably need pretreatment with a microfiltration or ultrafiltration membrane. The recovered sucrose can be passed to the A or B crystallizer for crystallization to raw sugar.

Many other intermediate liquors or syrups such as thick juice, A molasses, or B molasses, can be treated in a similar way.

Figure 3:
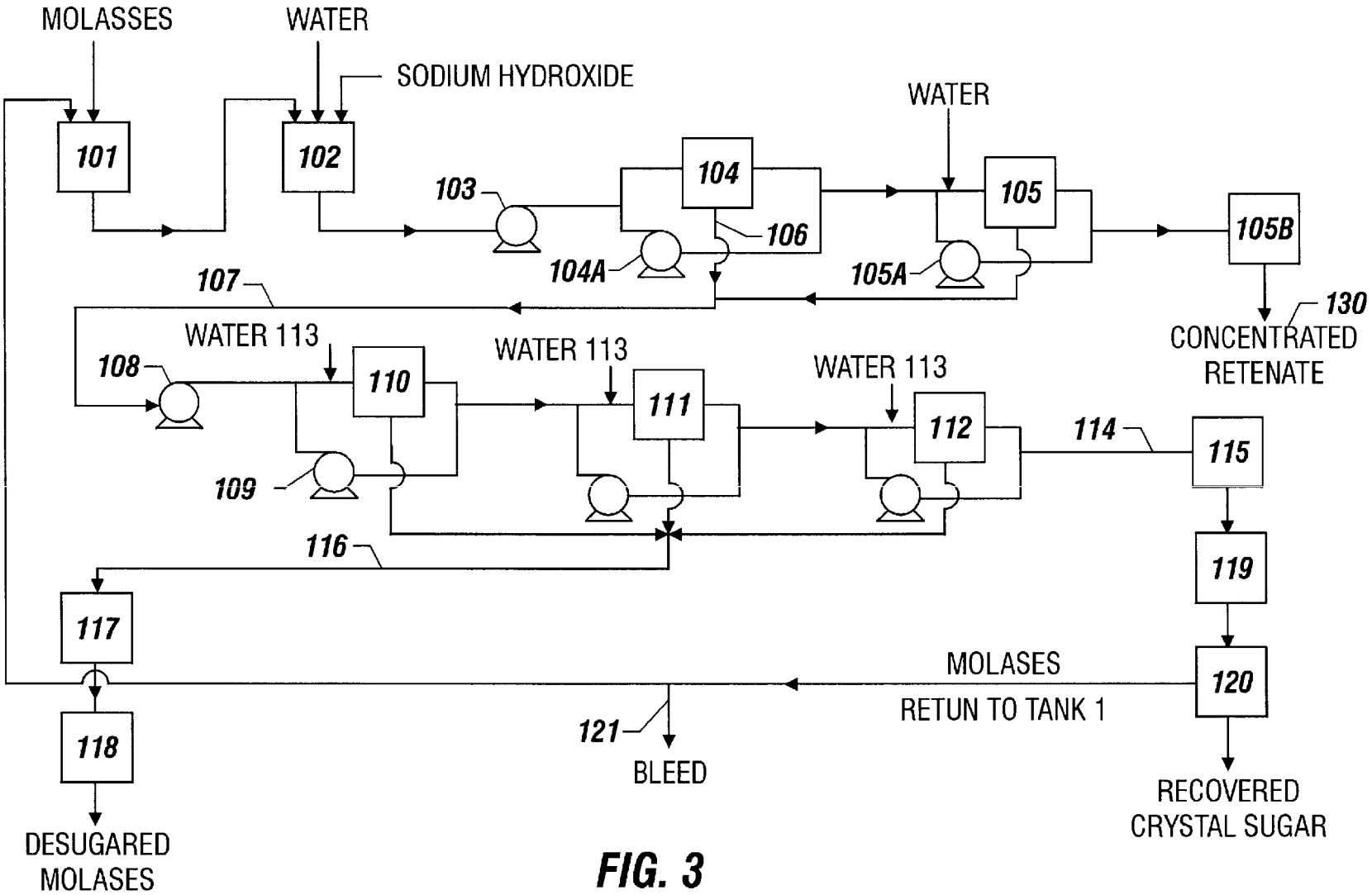
FIG. 3 is a process flow diagram for a process of the present invention for recovering sucrose from molasses.

One specific embodiment of a nanofiltration process to separate sucrose from either cane factory (mill) or refinery molasses is shown in FIG. 3. Molasses is produced from the recovery or remelt process of conventional cane sugar refinery. This molasses will typically have a sucrose content of 40 to 50%, an invert content of 10 to 25%, and an ash content of 10 to 15%, with other impurities making up the remainder. This molasses 101 can be diluted, and the pH can be adjusted with sodium hydroxide in step 102. The concentration of the molasses preferably is reduced from about 80 Brix to about 25 Brix, and the pH preferably is adjusted to about pH 7.0. The diluted molasses can then pumped by pump 103 to a microfiltration or ultrafiltration membrane 104. A recirculating pump 104A pumps the diluted molasses across the membrane in a crossflow manner. This membrane removes colloidal material, polysaccharides and some color, and provides a diluted molasses that has a very low turbidity. The percentage of sucrose, invert, and ash is hardly changed in this type of membrane; its only purpose is to remove suspended solids and materials that would interfere with the performance of the nanofiltration membrane.

The retentate of the microfiltration or ultrafiltration membrane can be concentrated several times and then passed to a diafiltration system 105 to wash sucrose from the retentate. Diafiltration water is added to the retentate to accomplish this. A recirculating pump 105A pumps the diluted retentate from the main microfiltration system over the diafiltration membrane. This dilute stream, which is the permeate of the diafiltration membrane, is returned to the main stream of dilute molasses 106. The final retentate 130 of the microfiltration or ultrafiltration is very low in sucrose content, and can be added to the final desugared molasses for use as a cattle feed. It must first be concentrated in evaporator 105B.

The diluted and filtered molasses stream 107 can be processed by a nanofiltration membrane. As this nanofiltration membrane is typically operated at high pressure, a feed pump 108 is required, plus a recycle pump 109 to pass the diluted molasses over the nanofiltration membrane 110. Several stages of nanofiltration (111, 112) may be required, with the addition of diafiltration water 113. Two streams are produced by the nanofiltration. One is the retentate 114, in which the sucrose content has been increased. This retentate is concentrated in an evaporator 115. This evaporated syrup stream which will typically contain 75% sucrose can then be sent to a crystallizer 119 and centrifuge 120 to crystallize and recover sugar. The molasses from this crystallization that has been separated from recovered crystal sugar by centrifuge 120 can be recycled to the molasses supply tank 101 for further treatment. A bleed stream 121 from this line will prevent the buildup of undesirable impurities in the system.

The other stream produced by the nanofiltration is the permeate 116, which contains the impurities that have been removed, mainly invert and ash, plus some sucrose and some organics such as lactic acid. A typical composition will be sucrose 12%, invert 45%, ash 30%, and other organics 13%. This stream also needs to be concentrated, and this can be done using an evaporator, or a reverse osmosis membrane system 117 followed by an evaporator 118. This concentrated desugared molasses stream can be sold as a fermentation syrup or an animal feed.

Figure 4:
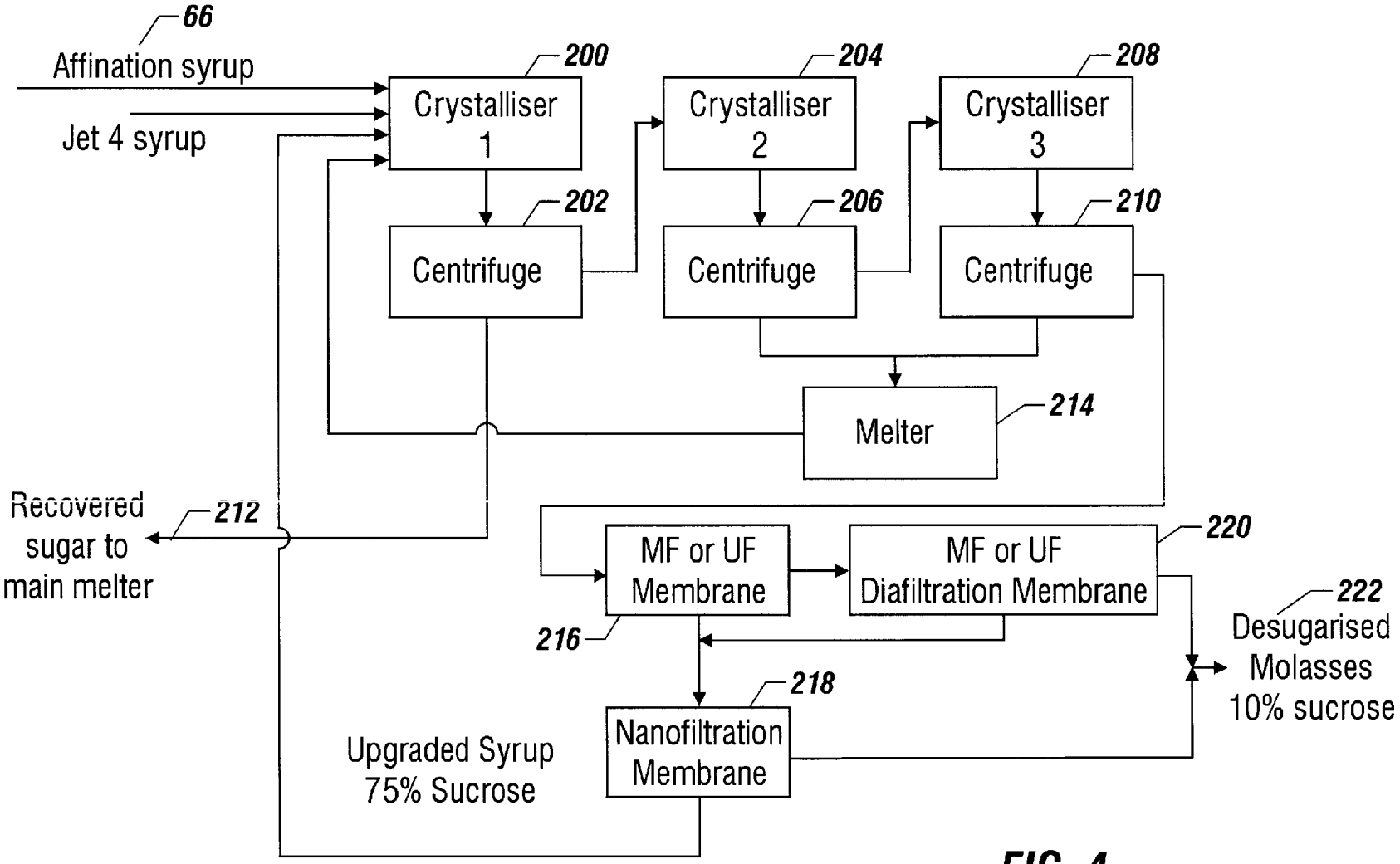
FIG. 4 is a process flow diagram for another process of the present invention in which sucrose is recovered from molasses.

FIG. 4 shows another embodiment of a nanofiltration process of the present invention. Affination syrup 66 and/or jet 4 syrup (the mother liquor of the fourth white sugar crystallization) are processed through a series of three crystallizers (200, 204, 208) and associated centrifuges (202, 206, 210). Crystals 212 recovered from the first centrifuge 202 are combined with the main sugar stream in the melter. Crystals recovered from the second and third centrifuges 206 and 210 pass into a melter 214, and then into the first crystallizer 200. The syrup produced by the third centrifuge 210 is first microfiltered or ultrafiltered 216, and then nanofiltered 218. A diafiltration module 220, which comprises a microfiltration or ultrafiltration membrane, is used to wash some residual sucrose from the retentate of the microfiltration/ultrafiltration 216. The sucrose stream recovered by this diafiltration 220 is combined with the microfiltration/ultrafiltration permeate and fed to the nanofiltration 218. The nanofiltration permeate and the diafiltration permeated are combined to form a desugarized molasses stream 222, often containing as little as 10% or less sucrose. The nanofiltration retentate is recycled back to the first crystallizer 200.

The process of the present invention can also be used in processing sugar beets. The conventional process for producing sugar from sugar beet starts with the extraction of juice from sliced beets using water in a diffuser. This juice is then treated with lime in order to remove some impurities and destroy invert. The invert in the juice is destroyed by the high pH and high temperatures used in this conventional process, and the resulting thin juice has a very low invert level, typically 0.1%.

Some alternative beet processes involve treating the juice that is extracted from the sugar beets with a microfiltration or ultrafiltration membrane, and use either no lime or relatively low levels of lime. This membrane can filter out colloidal material and intermediate and high molecular weight material. However it does not increase the sucrose content of the juice by very much, usually less than 1 percentage point. This is a disadvantage because the yield of white sugar that can be obtained from the juice is directly proportional to its sucrose content.

One of the advantages of these membrane processes is that they can use much less lime than the conventional beet process. For example, the membrane processes can use 0 to 2% of lime (based on the final weight of sugar produced) whereas the conventional process can use 6 to 10% lime on the final sugar. Although these low levels of lime make the process less expensive in terms of lime consumption, they do not destroy the invert present in the beet juice. This invert level can be from 1 to 8%, depending on the sugar beet type, how long it has been stored, and the storage conditions. The presence of this high a concentration of invert also reduces the sucrose content of the juice, further reducing the yield of white sugar.

The present invention allows invert and ash to be partially or completely removed from the beet juice that has been processed with a microfiltration or an ultrafiltration membrane. A typical beet juice after treatment with a microfiltration or ultrafiltration membrane comprises 87% sucrose, 3% invert, 4% ash and 6% other material. When further treated with nanofiltration according to the methods of this invention, most of the invert and some of the ash can be removed, giving a purified juice comprising 91.5% sucrose, 0.5% invert, 2% ash, and 6% other material. This material is a purer and superior material to concentrate and crystallize, giving a higher yield of white sugar crystals.

People skilled in this field will appreciate that many other implementations of this invention are possible.

Nanofiltration membranes for use in the present invention preferably have a molecular weight cutoff of about 100–500 Daltons, more preferably about 150–300 Daltons, and a magnesium chloride rejection of 96%. Suitable ultrafiltration membranes preferably will have a molecular weight cutoff of about 2000–100,000 daltons. Suitable microfiltration membranes preferably will have a pore size of about 0.02–0.2 microns. Suitable membrane systems are available from manufacturers such as Koch Membrane Systems, Wilmington, Mass. (USA); Osmonics/Desal, Vista, Calif. (USA); Dow Chemical Company, Midland, Mich. (USA); and SCT Membralox (France).

The invention can be further understood from the following examples.

EXAMPLE 1

The feed material used for this experiment was cane refinery molasses at about 75 Brix. 25 liters of this molasses was added to a 100 liter tank fitted with a heating coil. Water was added to dilute the molasses to 25 Brix, requiring about 50 liters of water, giving a total of 75 liters of diluted molasses. The pH of this diluted molasses was adjusted from its original value of pH 5.5 up to pH 7 using sodium hydroxide, and was then heated to 65° C. This material was filtered through a coarse bag filter and then through a cartridge filter of about 10 microns pore size, giving a clear diluted molasses feed material for the nanofiltration experiment. This material was pumped to the feed tank of a nanofiltration pilot plant, which has a volume of about 100 liters.

Figure 5:
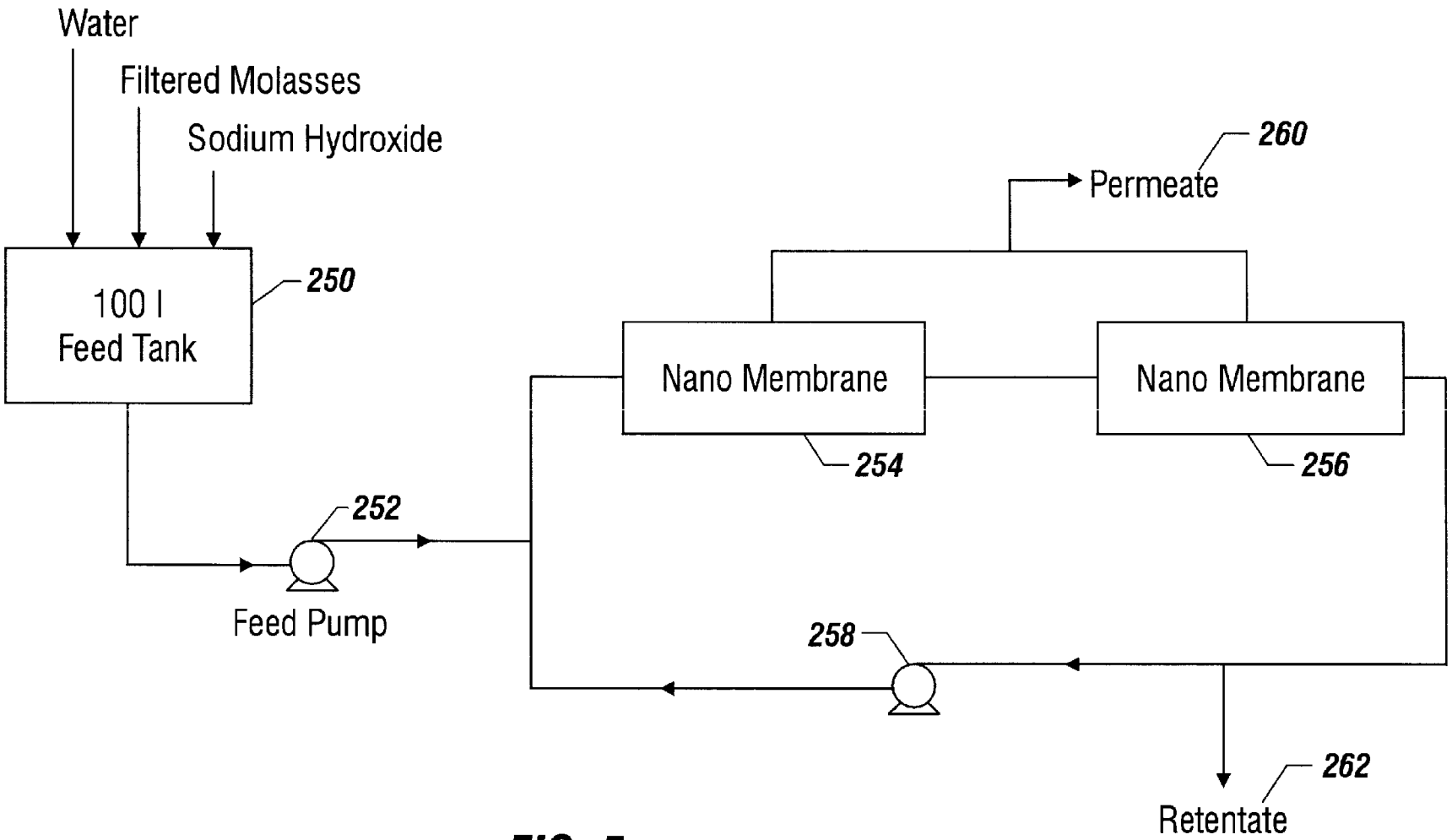
FIG. 5 is a process flow diagram of the operations performed in Example 1.

A process flow diagram for this experiment is shown in FIG. 5. The equipment included the feed tank 250, a feed pump 252, a pair of nanofiltration membranes (254, 256) in series, and a recirculation pump 258.

The nanofiltration equipment comprised two 4-inch spiral modules in series, and the membrane used was a Desal 5. The manufacturer of this membrane is Osmonics/Desal of Vista, Calif., USA. The membrane is designed to operate at 35 bar and the feed pump 252 was set to produce this pressure. The re-circulation pump 258 was set to give a pressure across the membrane modules of 12 psi.

Permeate 260 was collected from the two membrane modules. The permeate was not recycled to the feed tank and instead was collected over the period of time of the experiment. An amount of water approximately equal to the permeate volume was added to the feed to prevent the Brix of the feed from rising too high. The retentate 262 was recycled to the feed tank 250.

The volume of permeate over a period of time was measured to calculate the permeate flow rate of the two modules. The removal of permeate and addition of water in the feed tank were continued until the amount of water added was 3 times the original feed volume. The experiment was then stopped and the collected samples of retentate and permeate taken for analysis. The results of this analysis are shown in Table 1 (all percentages are by weight on a dry solids basis). The flux is given as liters per hour per square meter (lmh).

TABLE 1

| | Retentate initial (feed) | Retentate final | Permeate average |
|---|---|---|---|
| Sucrose (%) | 49.6 | 61.9 | 36 |
| Invert (%) | 19.2 | 2.4 | 22.1 |
| Ash (cond.) (%) | 16.8 | 8.2 | 24.8 |
| Brix | 27 | 26.8 | 4.6 |
| Flux (lmh) | | | 14 |

The analysis of sucrose, glucose, and fructose (the latter two added to give invert) was carried out on a Hewlett Packard HPLC using a Waters 6.5×300 mm Sugar-Pak HPLC column. Ash was measured by conductivity using an Alpha 200 conductivity meter.

It was found that the sucrose content of the molasses had been increased from 49.6% to 61.9%. The invert was reduced from 19.2% to 2.4%, and the ash reduced from 16.8% to 8.2%.

EXAMPLE 2

The feed material for this experiment was cane refinery molasses at 75 Brix. About 50 liters of this molasses was added to a 200 liter tank. Water was added to dilute the molasses to 25 Brix, requiring about 100 liters of water. The pH of this diluted molasses was raised from its natural level of pH 5.5 up to pH 7.0 by the addition of sodium hydroxide. It was then heated to 70° C. using a steam coil in the feed tank.

Figure 6:
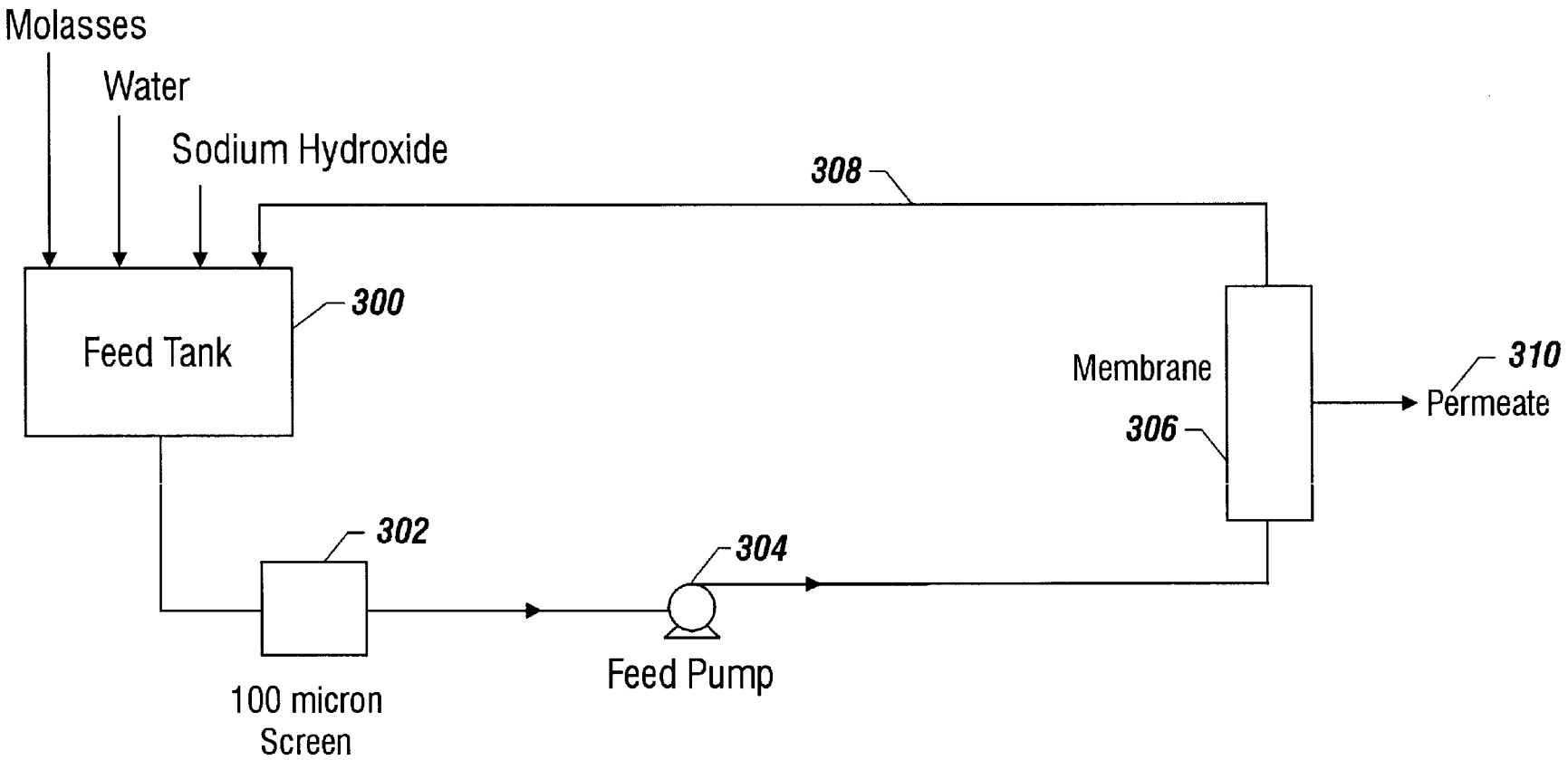
FIG. 6 is a process flow diagram of the operations performed in Examples 2 and 6.

The diluted molasses was pre-filtered using a microfiltration membrane. The equipment used for this pre-filtration is shown in FIG. 6, and comprised a feed tank 300, a screen 302, a feed pump 304, and a membrane module 306. The membrane used was a SCT ceramic membrane with a pore size of 0.1 microns. This membrane is available from SCT Membralox. The feed pump 304 was set to give a cross-flow velocity of 4 m/sec and the transmembrane pressure was set at 3 bar. The feed to the pump was passed through a 100-micron screen 302 to remove any suspended solids that could block the channels of the membrane. About 100 liters of permeate was collected and fed to the feed tank of the nanofiltration membrane.

The nanofiltration membrane system was then run according to the method described in Example 1, except that the feed material had been pre-filtered by microfiltration, rather than with a 10-micron cartridge filter.

The results are shown in Table 2. The analysis for sucrose, invert and ash were carried out as described in Example 1.

TABLE 2

| | Retentate initial (feed) | Retentate final | Permeate average |
|---|---|---|---|
| Sucrose (%) | 51.6 | 70.1 | 18.4 |
| Invert (%) | 17.2 | 2.7 | 45.5 |
| Ash (cond.) (%) | 12.4 | 4.2 | 14.9 |
| Brix | 30.1 | 30.8 | 7.4 |
| Flux (lmh) | | | 21 |

The sucrose content of the molasses was increased from 51.6% to 70.1%, and the invert decreased from 17.2% to 2.7%. The ash was decreased from 12.4% to 4.2%. There was 18.4% sucrose in the permeate 310.

EXAMPLE 3

This experiment used refinery first crop syrup. This syrup is the mother liquor from the first crystallization in the recovery of remelt process. The feed for this crystallization is affination syrup and a liquor that is termed "jet 4", the mother liquor from the fourth white sugar boiling. The sucrose content of first crop syrup can typically range from 70% to 78%. The syrup used for the experiment had a sucrose content of 75.5% by weight (d.s.b.).

All conditions and methods for Example 3 were as used in Example 2, including the microfiltration pretreatment. As shown in Table 3, the sucrose content was increased from 75.5% up to 83.3% and there was 31% sucrose in the permeate.

TABLE 3

| | Retentate initial (feed) | Retentate final | Permeate average |
|---|---|---|---|
| Sucrose (%) | 75.5 | 83.3 | 31 |
| Invert (%) | 11.4 | 2.6 | 39 |
| Ash (cond.) (%) | 19.1 | 7.4 | 4.2 |
| Brix | 25.7 | 30.7 | 5.6 |
| Flux (lmh) | | | 30 |

EXAMPLE 4

The feed for this experiment was affination syrup. The conditions and methods of the experiment were the same as Example 2, including the microfiltration pretreatment. As shown in Table 4, the sucrose content of the affination syrup was increased from 81.5% to 89.7%. The permeate contained 40% sucrose.

TABLE 4

| | Retentate initial (feed) | Retentate final | Permeate average |
|---|---|---|---|
| Sucrose (%) | 81.5 | 89.7 | 40 |
| Invert (%) | 6.1 | 2.0 | 32 |
| Ash (cond.) (%) | 5.9 | 2.6 | 18.5 |
| Brix | 28 | 27.4 | 2.7 |
| Flux (lmh) | | | 30 |

EXAMPLE 5

This experiment used as a feed material evaporated clarified juice from a sugar cane mill. This material is the evaporated form of the juice obtained by washing cane in a cane mill.

The conditions and methods of the experiment were the same as in Example 2, including the microfiltration pretreatment. The results are shown in Table 5.

TABLE 5

| | Retentate initial (feed) | Retentate final | Permeate average |
|---|---|---|---|
| Sucrose (%) | 88.7 | 91.4 | 24.0 |
| Invert (%) | 2.7 | 1.5 | 34 |
| Ash (cond.) (%) | 3.0 | 1.0 | 26 |
| Brix | 24.2 | 22.0 | 3.6 |
| Flux (lmh) | | | 29 |

EXAMPLE 6

This experiment used cane refinery molasses. This material was pre-treated through a microfiltration membrane as described in Example 2. After this pre-treatment, the diluted filtered molasses was then further filtered through an ultrafiltration membrane, using an equipment configuration as shown in FIG. 6.

The equipment used for ultrafiltration was the same as that used for microfiltration, but the membrane used was an Osmonics GH 2500 cl having a molecular weight cutoff of 2,500 Daltons. This membrane is available from Osmonics. The process conditions used were similar to the microfiltration, but the operating pressure used was 10 bar and the cross-flow pressure was 0.7 bar. The permeate was collected from this procedure and this was used as the feed to the nanofiltration. The procedures and equipment used for nanofiltration were as described in Example 1.

As shown in Table 6, the sucrose content of the molasses was increased from 52.1% to 75.1% and the sucrose in the permeate was 18.4%.

TABLE 6

| | Refinery Molasses | | |
|---|---|---|---|
| | Retentate initial (feed) | Retentate final | Permeate average |
| Sucrose (%) | 52.1 | 75.1 | 18.4 |
| Invert (%) | 22.8 | 2.8 | 45.5 |
| Ash (cond.) (%) | 16.8 | 7.0 | 14.9 |

TABLE 6-continued

| | Refinery Molasses | | |
|---|---|---|---|
| | Retentate initial (feed) | Retentate final | Permeate average |
| Brix | 32.6 | 23.4 | 7.4 |
| Flux (lmh) | | | 37 |

EXAMPLE 7

This experiment used beet juice produced by filtering through a membrane. This was obtained by taking juice obtained by diffusion of beets, and filtering it through an ultrafiltration membrane with a pore size of from 10,000 to 50,000 daltons. The beets used had been stored for a few months and the sucrose content of the juice obtained was relatively low at 86% with 3% of invert. The pH was adjusted to pH 7 with sodium hydroxide; lime was not used for either pH adjustment or destruction of invert.

All conditions and methods for Example 7 were as used in Example 1, except prefiltration through a coarse bag filter and a cartridge filter were not required, as the juice was already free of suspended solids having passed through an ultrafiltration membrane. The results are shown in Table 7.

TABLE 7

| | Retentate initial (feed) | Retentate final | Permeate average |
|---|---|---|---|
| Sucrose (%) | 86 | 91 | 35 |
| Invert (%) | 3 | 0.2 | 22 |
| Ash (cond.) (%) | 5.2 | 1.3 | 32 |
| Brix | 15 | 15 | 2.5 |
| Flux (lmh) | | | 10 |

The nanofiltration membrane used in all of the above examples was a Desal 5. Other nanofiltration membranes that can be used are Hydranautics NTR 7450, AMT ATP 50 or ASP 50, or Dow NF 45.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A process for obtaining sucrose from a sucrose-containing syrup, comprising the steps of:

(a) nanofiltration of a feed syrup that comprises sucrose and no less than about 2% by weight invert sugars (on a dry solids basis) using a nanofiltration membrane, whereby a nanofiltration permeate and a nanofiltration retentate are produced, wherein the nanofiltration permeate comprises invert sugars, and wherein the nanofiltration retentate has:

(i) a concentration of sucrose that on a dry solids basis is higher than the concentration of sucrose in the feed syrup, and (ii) a concentration of invert sugars that on a dry solids basis is lower than the concentration of invert sugars in the feed syrup; and (b) recovery of the nanofiltration retentate.

2. The process of claim 1, further comprising the step of:

(c) crystallization of sucrose from the nanofiltration retentate.

3. The process of claim 1, wherein the feed syrup comprises at least about 5% invert sugars on a dry solids basis.

4. The process of claim 3, wherein the feed syrup comprises at least about 15% invert sugars on a dry solids basis.

5. The process of claim 1, wherein more than about 50% by weight of the invert sugars in the feed syrup pass through the nanofiltration membrane and into the nanofiltration permeate.

6. The process of claim 5, wherein more than about 75% by weight of the invert sugars in the feed syrup pass through the nanofiltration membrane and into the nanofiltration permeate.

7. The process of claim 6, wherein more than about 90% by weight of the invert sugars in the feed syrup pass through the nanofiltration membrane and into the nanofiltration permeate.

8. The process of claim 1, wherein the feed syrup is selected from the group consisting of cane mill molasses, mill first juice, mixed juice, incubated juice, clarified juice, thick juice, and mixtures thereof.

9. The process of claim 1, wherein the feed syrup is selected from the group consisting of cane refinery molasses, affination syrup, jet syrup, run-off syrup, first crop syrup, second crop syrup, and mixtures thereof.

10. The process of claim 1, wherein the feed syrup is selected from the group consisting of beet molasses, beet juice, beet thick juice, beet thin juice, and mixtures thereof.

11. The process of claim 1, wherein the nanofiltration membrane has a molecular weight cutoff of about 100–500 daltons.

12. The process of claim 11, wherein the nanofiltration membrane has a molecular weight cutoff of about 150–300 daltons.

13. The process of claim 1, wherein prior to nanofiltration, the feed syrup is filtered through a microfiltration or ultrafiltration membrane, whereby a microfiltration or ultrafiltration retentate and a microfiltration or ultrafiltration permeate are produced, and wherein the microfiltration or ultrafiltration permeate is filtered through the nanofiltration membrane, and wherein the microfiltration or ultrafiltration retentate comprises at least one impurity that was present in the feed syrup and is selected from the group consisting of colloids, polysaccharides, and color-forming materials.

14. The process of claim 13, wherein more than about 50% by weight of the colloids, polysaccharides, and color-forming materials in the feed syrup pass into the microfiltration or ultrafiltration retentate.

15. The process of claim 13, further comprising the step of diafiltration of the microfiltration or ultrafiltration retentate, whereby a diafiltration retentate and a diafiltration permeate are produced, and wherein the diafiltration retentate has a reduced sucrose content compared to the microfiltration or ultrafiltration retentate.

16. The process of claim 15, wherein the diafiltration permeate is combined with the microfiltration or ultrafiltration permeate prior to nanofiltration.

17. The process of claim 1, wherein the crystallization in step (b) produces a molasses byproduct that is recycled into the feed syrup prior to nanofiltration.

18. The process of claim 17, wherein a bleed stream is withdrawn from the molasses byproduct in an amount sufficient to prevent buildup of impurities in the process to an extent that would inhibit crystallization of sucrose.

* * * * *